US007681663B2

(12) United States Patent
Cobern

(10) Patent No.: US 7,681,663 B2
(45) Date of Patent: Mar. 23, 2010

(54) METHODS AND SYSTEMS FOR DETERMINING ANGULAR ORIENTATION OF A DRILL STRING

(75) Inventor: Martin E. Cobern, Cheshire, CT (US)

(73) Assignee: APS Technology, Inc., Wallingford, CT (US)

( * ) Notice: Subject to any disclaimer, the term of this patent is extended or adjusted under 35 U.S.C. 154(b) by 567 days.

(21) Appl. No.: 11/416,009

(22) Filed: May 1, 2006

(65) Prior Publication Data

US 2006/0260843 A1 Nov. 23, 2006

Related U.S. Application Data

(60) Provisional application No. 60/676,072, filed on Apr. 29, 2005.

(51) Int. Cl.
*E21B 7/04* (2006.01)
*E21B 47/024* (2006.01)

(52) U.S. Cl. ..... 175/45; 175/61; 73/152.43

(58) Field of Classification Search ..... 175/40, 175/45, 61, 24, 73; 73/152.01, 152.43; 702/6, 702/9, 10; 324/344, 345
See application file for complete search history.

(56) References Cited

U.S. PATENT DOCUMENTS

| | | | | |
|---|---|---|---|---|
| 4,114,435 | A * | 9/1978 | Patton et al. | 73/152.45 |
| 4,763,258 | A * | 8/1988 | Engelder | 340/853.3 |
| 4,901,804 | A * | 2/1990 | Thometz et al. | 175/40 |
| 5,200,705 | A * | 4/1993 | Clark et al. | 324/338 |
| 5,394,950 | A * | 3/1995 | Gardes | 175/45 |
| 5,678,643 | A * | 10/1997 | Robbins et al. | 175/45 |
| 6,109,370 | A | 8/2000 | Gray | 175/61 |
| 6,116,354 | A | 9/2000 | Buytaert | 175/55 |
| 6,267,185 | B1 * | 7/2001 | Mougel et al. | 175/57 |
| 6,272,434 | B1 * | 8/2001 | Wisler et al. | 702/9 |
| 6,518,756 | B1 * | 2/2003 | Morys et al. | 324/303 |
| 6,585,061 | B2 * | 7/2003 | Radzinski et al. | 175/45 |
| 6,651,496 | B2 * | 11/2003 | Van Steenwyk et al. | 73/152.03 |
| 6,714,138 | B1 | 3/2004 | Turner et al. | 340/854.3 |
| 2005/0022404 | A1 * | 2/2005 | Ash et al. | 33/366.13 |
| 2006/0034154 | A1 | 2/2006 | Perry | 367/84 |
| 2006/0215491 | A1 | 9/2006 | Hall | 367/83 |
| 2006/0243487 | A1 | 11/2006 | Turner | 175/26 |

FOREIGN PATENT DOCUMENTS

| | | | |
|---|---|---|---|
| EP | 1 264 960 | A2 | 12/2002 |
| GB | 2301438 | A * | 12/1996 |

* cited by examiner

*Primary Examiner*—Kenneth Thompson
(74) *Attorney, Agent, or Firm*—Woodcock Washburn LLP

(57) ABSTRACT

Preferred methods and systems generate a control input based on a periodically-varying characteristic associated with the rotation of a drill string. The periodically varying characteristic can be correlated with the magnetic tool face and gravity tool face of a rotating component of the drill string, so that the control input can be used to initiate a response in the rotating component as a function of gravity tool face.

36 Claims, 7 Drawing Sheets

METHODS AND SYSTEMS FOR DETERMINING ANGULAR ORIENTATION OF A DRILL STRING

This application claims priority under 35 U.S.C. § 119(e) to U.S. provisional application No. 60/676,072, filed Apr. 29, 2005, the contents of which is incorporated by reference herein in its entirety.

Pursuant to 35 U.S.C. § 202(c), it is acknowledged that the U.S. government may have certain rights to the invention described herein, which was made in part with funds from the U.S. Department of Energy National Energy, Grant No. DE-FG02-02ER83368.

FIELD OF THE INVENTION

The present invention relates to underground drilling. More specifically, the invention relates to methods and systems for initiating an action in a rotating component of a drill string based on the angular position of the rotating component.

BACKGROUND OF THE INVENTION

Underground drilling, such as gas, oil, or geothermal drilling, generally involves drilling a bore through a formation deep in the earth. Such bores are formed by connecting a drill bit to long sections of pipe, referred to as "drill collars" and "drill pipe," so as to form an assembly commonly referred to as a "drill string." The drill string extends from the surface to the bottom of the bore.

The drill bit is rotated so that the drill bit advances into the earth, thereby forming the bore. In a drilling technique commonly referred to as rotary drilling, the drill bit is rotated by rotating the drill string at the surface. In other words, the torque required to rotate the drill bit is generated above ground, and is transferred to the drill bit by way of the drill string.

Alternatively, the drill bit can be rotated by a drilling motor. The drilling motor is usually mounted in the drill string proximate the drill bit. The drill bit can be rotated by the drilling motor alone, or by rotating the drill string while operating the drilling motor.

One type of drilling motor known as a "mud motor" is powered by drilling mud. Drilling mud is a fluid that is pumped at high pressure from the surface, through an internal passage in the drill string, and out through the drill bit. The drilling mud lubricates the drill bit, and flushed cuttings from the path of the drill bit. The drilling mud then flows to the surface through an annular passage formed between the drill string and the surface of the bore.

In a drill string equipped with a mud motor, the drilling mud is routed through the drilling motor. The mud motor is equipped with a rotor that generates a torque in response to the passage of the drilling mud therethrough. The rotor is coupled to the drill bit so that the torque is transferred to the drill bit, causing the drill bit to rotate.

Drilling operations can be conducted on a vertical, horizontal, or directional basis. Vertical drilling refers to drilling in which the trajectory of the drill string is inclined approximately 10° or less in relation to the vertical. Horizontal drilling refers to drilling in which the drill-string trajectory is inclined approximately 90°. Directional drilling refers to drilling in which the trajectory of the drill-string is inclined between approximately 10° and approximately 90°.

Various systems and techniques can be used to perform directional and horizontal drilling. For example, so-called "steerable systems" use a drilling motor with a bent housing incorporated into the bottom-hole assembly of the drill string. A steerable system can be operated in a sliding mode in which the drill string is not rotated, and the drill bit is rotated exclusively by the drilling motor. The bent housing steers the drill bit in the desired direction as the drill string slides through the bore, thereby effectuating directional drilling. Alternatively, the steerable system can be operated in a rotating mode in which the drill string is rotated while the drilling motor is running. This technique results in a substantially straight bore.

So-called "rotary steerable tools" can also be used to perform directional drilling. One particular type of rotary steerable tool can include pads or arms located on the drill string, proximate the drill bit. The arms can extend and retract at some fixed orientation during some, or every revolution of the drill string. Contact the between the arms and the surface of the drill hole exerts a lateral force on the portion of the drill string proximate the drill bit. This force pushes or points the drill bit in the desired direction of drilling. A substantially straight bore is drilled when the arms remain in their retracted positions.

Directional drilling can also be accomplished using a so-called "rotary steerable motor" as described, for example, in U.S. Pat. No. 7,389,830, entitled Rotary Steerable Motor System For Underground Drilling, the contents of which is incorporated by reference herein in its entirety. Rotary steerable motors typically comprise a drilling motor that forms part of the bottom-hole assembly, and also include some type of steering means, such as the extendable and retractable arms discussed above in relation to the rotary steerable tool. In contrast to steerable systems, rotary steerable motors permit directional drilling to be conducted while the drill string is rotating. Hence, a rotary steerable motor can usually achieve a higher rate of penetration during directional drilling than a steerable system or a rotary steerable tool, since the combined torque and power of the drill string rotation and the motor are applied to the bit.

Directional and horizontal drilling require real-time knowledge of the angular orientation of a fixed reference point on the circumference of the drill string in relation to a reference point on the bore. The reference point is typically magnetic north in a vertical well, or the high side of the bore in an inclined well. This orientation of the fixed reference point is typically referred to as "tool face," or "tool face angle." For example, drilling with a steerable motor requires knowledge of the tool face so that the pads can be extended and retracted when the drill string is in a particular angular position, so as to urge the drill bit in the desired direction.

Tool face, when based on a reference point corresponding to magnetic north, is commonly referred to as "magnetic tool face" (MTF). When based on a reference point corresponding to the high side of the bore, tool face is commonly referred to as "gravity tool face" (GTF). The desired heading for steering during directional and horizontal drilling is usually expressed in terms of GTF, once the initial angle has been established.

GTF is usually determined based on measurements of the transverse components of the local gravitational field, i.e., the components of the local gravitational field perpendicular to the axis of the drill string. These measurements are typically acquired using accelerometers. Acquiring instantaneous measurements of the local gravitational field during rotary drilling is usually not possible, however, because the vibrations of the drill string can be many times greater than one g, i.e., one times the force of gravity.

MTF is usually determined based on measurements of the transverse components of the earth's local magnetic field.

These measurements are typically acquired using a magnetometer. Acquiring measurements the earth's local magnetic field during rotary drilling, however, can also present difficulties. For example, a typical drill string can rotate at an angular velocity of approximately 180 revolutions per minute (rpm), or 1,080 degrees per second. The substantially instantaneous determination of MTF under such conditions requires that the components of the transverse magnetic field be measured with sufficient accuracy, and that MTF be calculated in milliseconds. This requirement can place a large, and potentially unacceptable computing load on the down hole data processing equipment used to acquire and calculate MTF. Also, the presence of magnetic material in the drill string proximate the magnetometer can perturb the geomagnetic field, and thereby introduce inaccuracies into the calculation of MTF.

Moreover, as the desired heading for directional and horizontal drilling is usually expressed in terms of GTF, MTF usually needs to be converted to GTF. This conversion typically requires a relatively complex series of mathematical calculations. The need to perform these calculations at a relatively high rate can further increase the computing load the down-hole data processing equipment.

Consequently, an ongoing need exists for methods and systems that permit a down-hole component of a rotating drill string to be activated based on the orientation of the component referenced to GTF, while minimizing the associated computing load.

SUMMARY OF THE INVENTION

Preferred methods and systems generate a control input based on a periodically-varying characteristic associated with the rotation of a drill string. The periodically varying characteristic can be correlated with the magnetic tool face and gravity tool face of a rotating component of the drill string, so that the control input can be used to initiate a response in the rotating component as a function of gravity tool face.

A preferred method comprises causing a drill string to rotate within an earth formation, monitoring a magnetic field as the drill string rotates, generating an electrical signal in response to a periodically-varying characteristic of the magnetic field, for example, the point at which a transverse magnetometer senses a zero field, and sending the electrical signal to a component of the drill string that is responsive to the electrical signal.

A preferred method comprises drilling a subsurface bore using a rotating drill string, and calculating a time required for a rotating component of the drill string to rotate through an angular displacement approximately equal to an angular distance between a first angular position of the rotating component, and a second angular position of the rotating component at which a predetermined response of the rotating component is occur.

A preferred method also comprises determining when the rotating component reaches the first angular position by measuring a quantity that varies with the rotation of the rotating component, and monitoring the time that elapses after the rotating component reaches the first angular position until at least the time that it reaches approximately the second angular position.

Another preferred method comprises determining gravity tool face, and apparent magnetic tool face (which may be influenced by the presence of magnetic materials in the drill string in proximity to the sensor) of a rotatable component while the rotatable component is not rotating, and determining an offset between the gravity tool face and the apparent magnetic tool face. A preferred method also comprises determining a first angular position by calculating a difference between the offset and a heading at which a desired action of the rotatable component is to take place, and measuring a component of a geomagnetic field around the rotatable component while the rotatable component is rotating.

A preferred method also comprises calculating an angular distance between the first angular position and a second angular position at which a measured value of the geomagnetic field is approximately zero, and calculating a time required for the rotatable component to rotate from the second angular position to the first angular position.

A preferred system comprises: (a) a directional sensor comprising three accelerometers that measure the components of the gravitational field in a coordinate system fixed to a drill string, a first magnetometer that measures the magnetic field in a coordinate system fixed to the tool, and a signal processing device, such as a microprocessor, that calculates an orientation of the tool and the offset between a current position and a desired heading; (b) a second sensor comprising a two-axis magnetometer and a signal processing device, such as a microprocessor, to measure the apparent angular orientation of the tool relative to North; (c) a communication device, such as a telemetry system, that facilitates communications between the directional sensor and the second magnetometer; and (d) a controller that signals an active element of the drill string, such as an arm of a rotary steerable motor, to extend in response to a periodically-varying characteristic of the magnetic measurement.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

Figure 1:
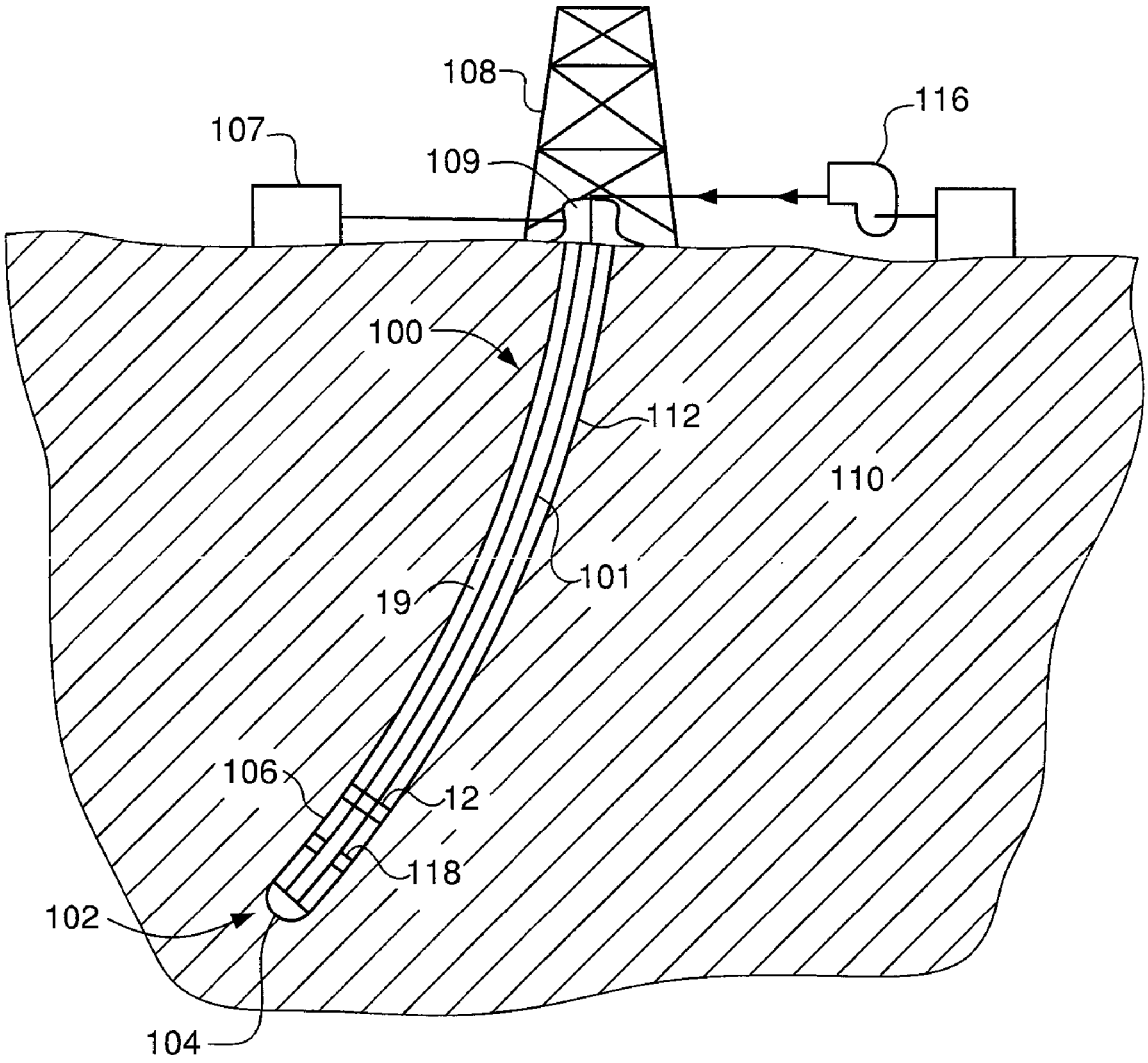
FIG. 1 is a side view of a drill string incorporating a preferred system for determining the angular orientation of a drill string.

The figures depict a preferred system 10 for determining the angular position of a rotating component of a drill string. The system 10 can be configured to generate an output when the rotating component is in a particular angular position. The output, when received by the rotating component, can initiate a response in the rotating component. The system 10 can be used as part of a drill string 100, depicted in FIGS. 1 and 2.

The drill string 100 is formed from interconnected sections of drill pipe 101, and a bottom hole assembly 102. The bottom hole assembly 102 comprises a drill bit 104, and a drill collar 106. The drill collar 106 couples the drill bit 104 and the lowermost section of drill pipe 101, and weights the drill bit 104 to improve the performance thereof.

The drill string 100 may be rotated by a motor 107 of a drilling rig 108 located on the surface, as shown in FIG. 1. Drilling torque can be transmitted from the motor 107 to the drill string 100 through a turntable or rotary table 109, and a square or hexagonal section of drill pipe commonly referred to as a "kelly" (not shown). Drilling torque is transmitted to the drill bit 104 by way of the drill pipe 101 and the drill collar 106. The rotating drill bit 104 advances into an earth formation 110, thereby forming a bore 112.

Drilling mud is pumped at high pressure from the surface, through the sections of drill pipe 101 and the drill collar 106, and out of the drill bit 104. The drilling mud is circulated by a pump 116 located on the surface. The drilling mud, upon exiting the drill bit 104, returns to the surface by way of an annular passage formed between the sections of drill pipe 101 and the surface of the bore 112, as depicted in FIG. 1.

The bottom-hole assembly 102 can be configured for directional drilling. For example, the bottom-hole assembly 102 can include a rotary steerable motor 118 located between the drill collar 106 and the drill bit 104. The rotary steerable motor 118 can include one or more pads, or arms 119 mounted on a housing 120 so that the arms 119 can extend and retract in relation to a housing 120. The arms 119 can be extended and retracted by a suitable means such as hydraulic actuators (not shown).

Figure 3:
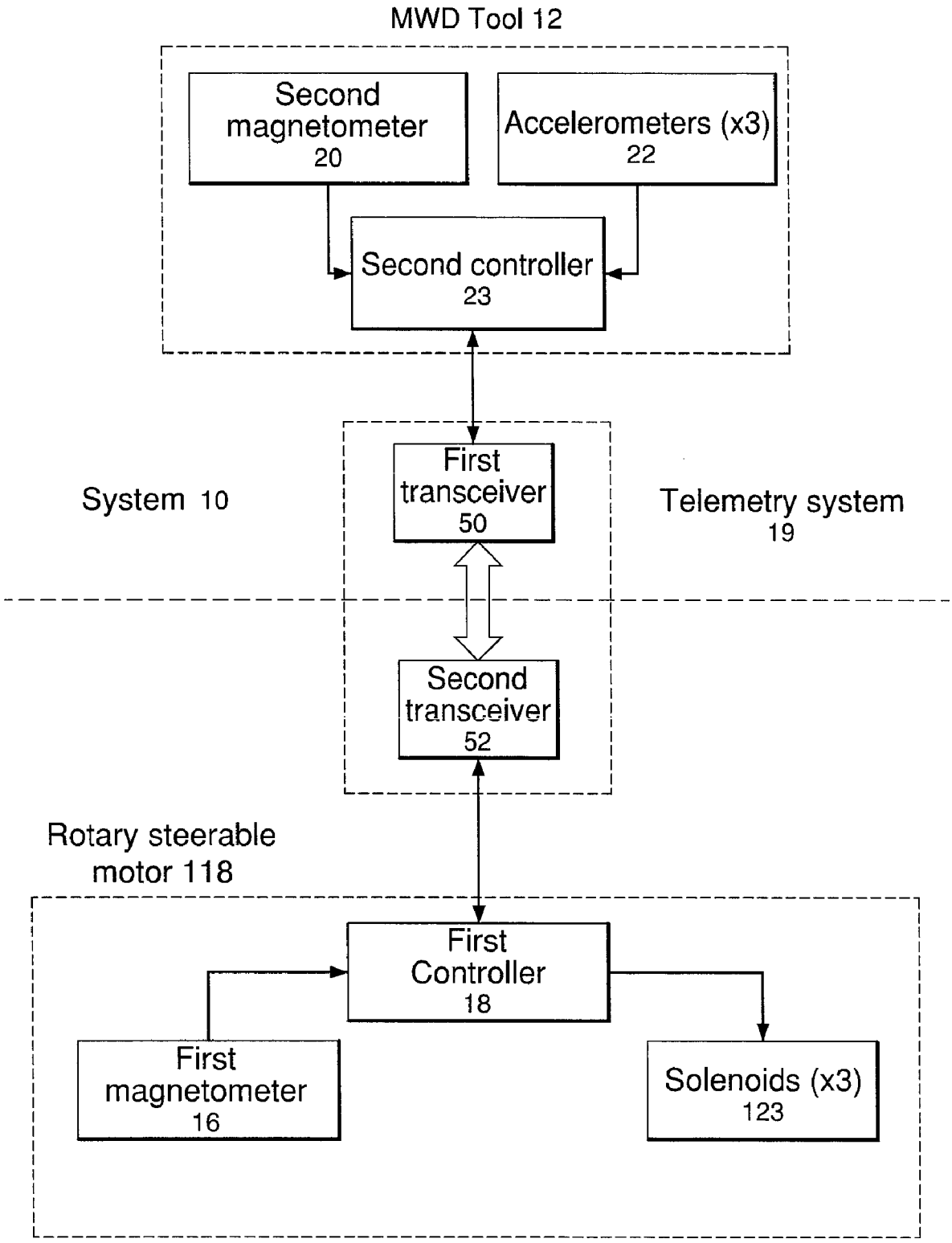
FIG. 3 is a block diagram of the system shown in FIGS. 1 and 2.

The extension and retraction of the arms 119 can be controlled by a controller 121 of the rotary steerable motor 118. The controller 121 is communicatively coupled to a first controller 18 of the system 10, as shown in FIG. 3. The controller 121 is also communicatively coupled to electric solenoids 123 each associated with a respective arm 119.

The controller 121 can generate electrical outputs in response to inputs from the first controller 18. The outputs of the controller 121 activate and deactivate the solenoids 123. The solenoids 123, when activated, direct pressurized hydraulic fluid to the associated arms 119 to cause the arm 119 to extend. Deactivation of the solenoids 123 isolates the associated arms 119 from the pressurized hydraulic fluid, causing the arms 119 to retract.

Contact the between the arms 119 and the surface of the bore 112 exerts a lateral force on the drill string 100. This force pushes or points the drill bit 104 in the desired direction of drilling. The bore 112 is drilled in a substantially straight direction when the arms 119 remain in their retracted positions.

The rotary steerable motor 118 can also include a power section (not shown) mechanically coupled to the drill bit 104. The power section imparts rotation to the drill bit 104 in response to the passage of drilling mud therethrough. Further details of the rotary steerable motor 118 are not necessary to an understanding of the present invention, and therefore are not presented herein.

A rotary steerable motor suitable for use as the rotary steerable motor 118 is described in the above-noted U.S. application Ser. No. 11/117,802.

The system 10 is described in connection with the rotary steerable motor 118 for exemplary purposes only. The system 10 can be used in connection with other types of rotatable components or devices, such as rotary steerable systems, having one or more operating characteristics that require synchronization with the angular orientation of the component or device.

The system 10 comprises a measurement while drilling (MWD) tool 12, a first magnetometer 16, the first controller 18, and a telemetry system 19.

The MWD tool 12 is located within the drill collar 106, up-hole of the drill bit 104 and the rotary steerable motor 118, as shown in FIG. 1. As is well-know to those skilled in the art of borehole surveying, the MWD tool 12 may employ a triaxial magnetometer 20, three orthogonal accelerometers 22, and a processor such as a microprocessor 30 to calculate the azimuth, inclination, magnetic toolface angle, and gravity toolface angle at a given survey point.

Figure 5:
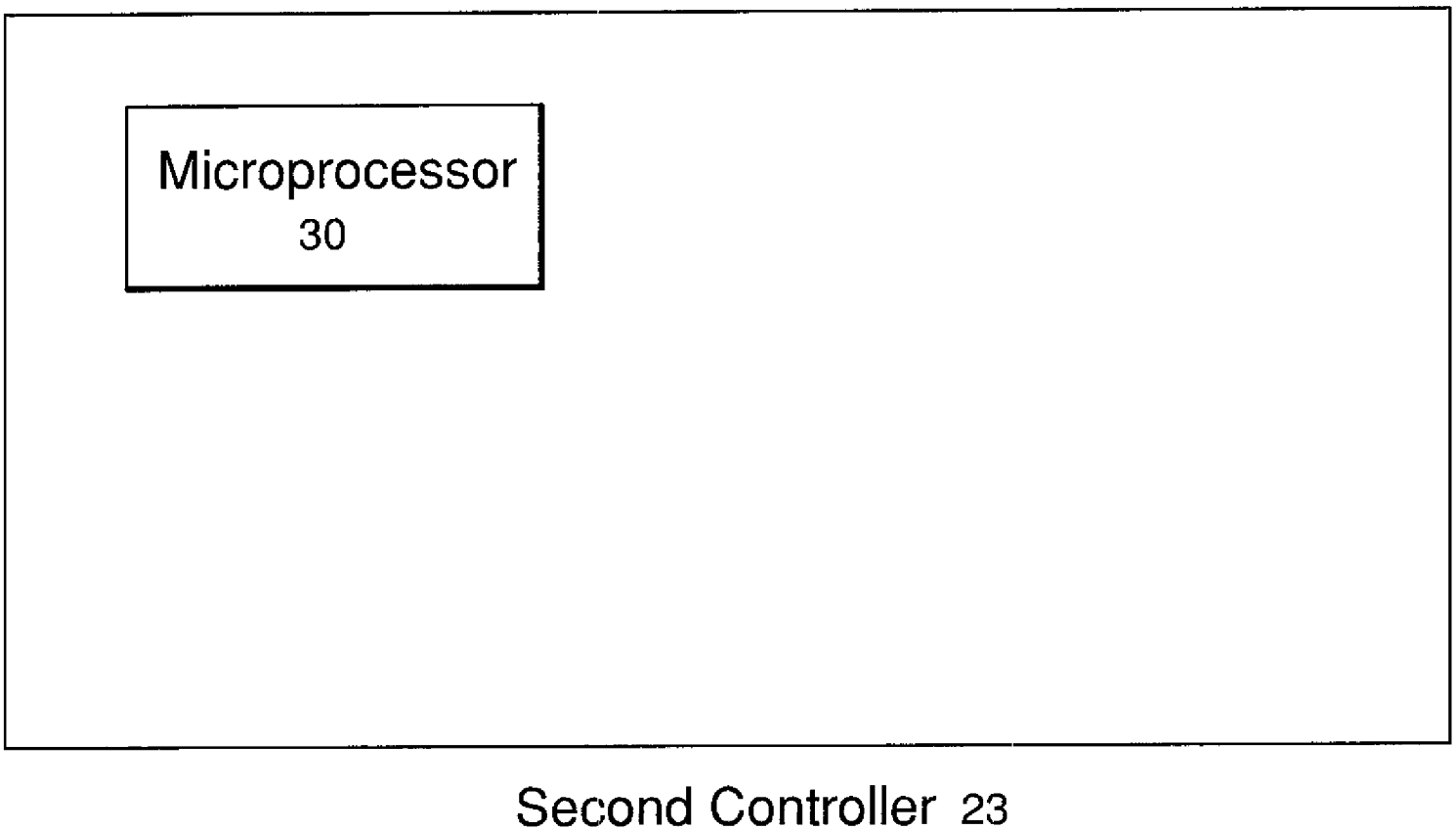
FIG. 5 is a block diagram of a second controller of the system shown in FIGS. 1-4.

The microprocessor 30 forms part of a second controller 23 communicatively coupled via the telemetry system 19 for communication with the rotary steerable motor 118, as shown in FIGS. 3 and 5.

The MWD tool 12 can be powered by a suitable means such as a battery (not shown), or a turbine-alternator driven (also not shown) by the drilling mud pumped through the drill string 100. The second magnetometer 20, the accelerometers 22, and the second controller 23 are preferably mounted in a pressure barrel (not shown) formed from a non-magnetic material such as beryllium-copper.

Information such as the desired heading of the drill string 100 can be transmitted between the MWD tool 12 and the surface using mud pulse telemetry or other suitable means. For example, the control inputs and information can be transmitted using systems and techniques described in U.S. Pat. No. 6,714,138 (Turner et al.); U.S. application Ser. No. 10/888,312, filed Jul. 9, 2004; and U.S. application Ser. No. 11/085,306, filed Mar. 2, 2005. The contents of each of these patents and applications is incorporated by reference herein in its entirety.

The first magnetometer 16 is preferably a bi-axial magnetometer that measures inclination about two mutually-perpendicular axes. The first magnetometer 16 is preferably mounted on the rotary steerable motor 118 at approximately the same angular position as one of the arms 119 (this particular arm is denoted by the reference character 119*a* in FIG. 2). The first magnetometer 16 is preferably mounted so that its first measurement axis, hereinafter referred to as the "y" axis, is substantially perpendicular to, and extending radially outward from the axis of rotation of the rotary steerable motor 118. A second, or "x" measurement axis is substantially perpendicular to both the axis of rotation and the "y" axis, and is substantially parallel to the tangent to the outer circumference of the rotary steerable motor 118. The axis of rotation of the rotary steerable motor 118 is denoted in FIG. 2 by the reference character "C."

Figure 2:
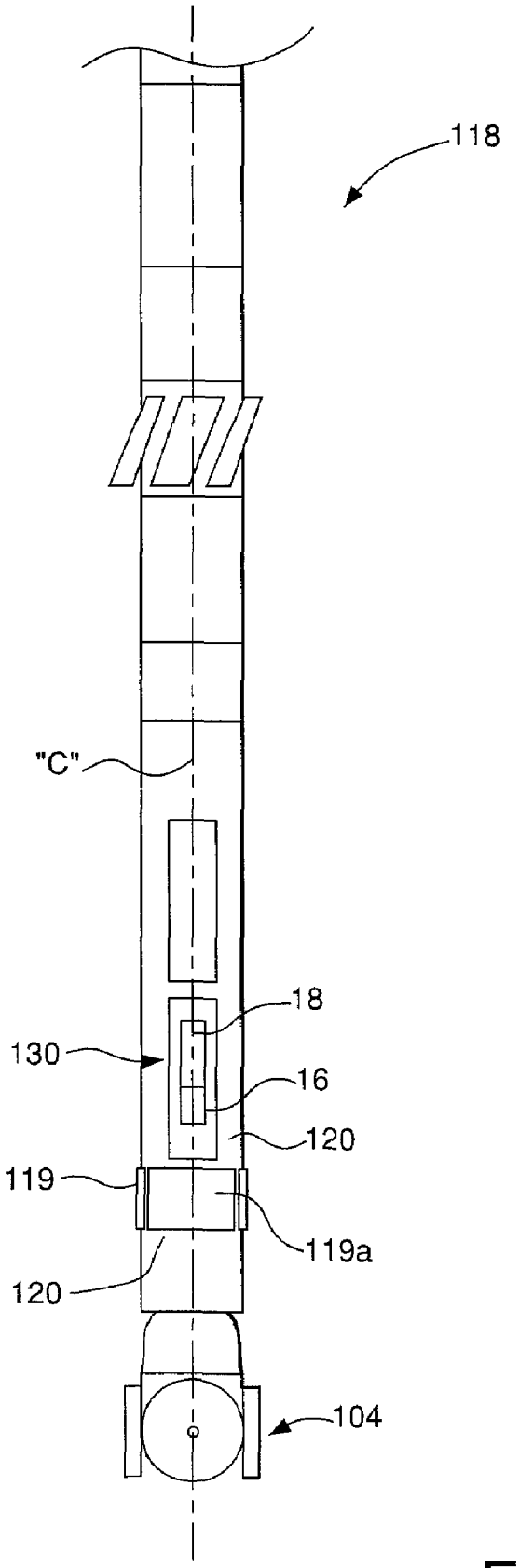
FIG. 2 is a side view of a rotary steerable tool of the drill string shown in FIG. 1, and various components of the system shown in FIG. 1.
Figure 4:
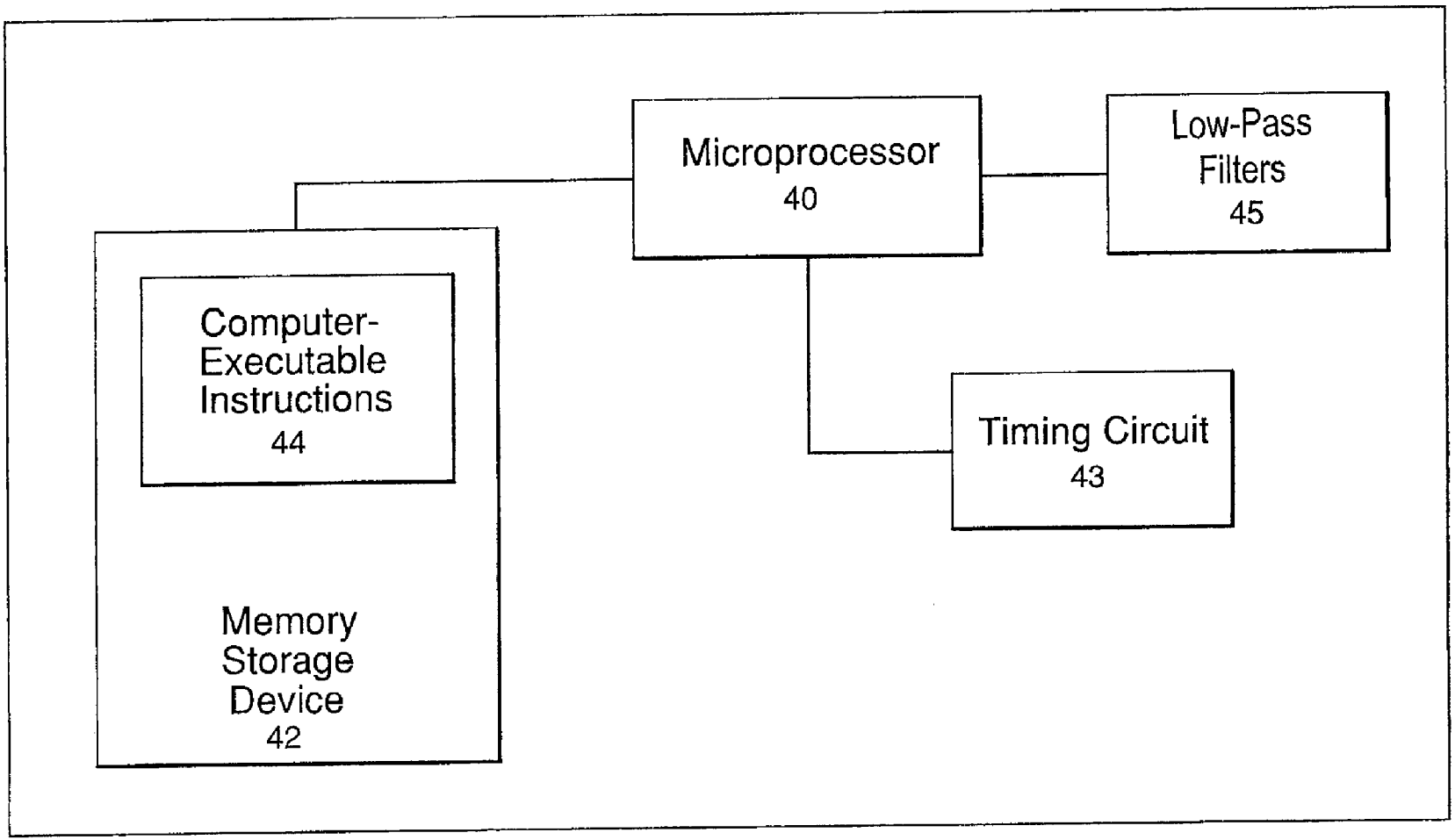
FIG. 4 is a block diagram of a first controller of the system shown in FIGS. 1-3.

The first controller 18 can comprise a processor such as a microprocessor 40, and a memory storage device 42 communicatively coupled to the microprocessor 40, as depicted in FIG. 4. The first controller 18 can also include a set of computer-executable instructions 44 stored on the memory storage device 42. As shown in FIG. 2, the first controller 18 can be mounted within a cavity 130 formed in the housing 120 of the rotary steerable motor 118, using a suspension or other suitable mounting means. The cavity 130 is covered and sealed during drilling operations by a cover. (FIG. 2 depicts the rotary steerable motor 118 with the cover removed, for illustrative purposes.)

The first controller 18 includes a timing circuit 43 communicatively coupled to the microprocessor 40, as shown in FIG. 4. The timing circuit 43 is preferably configured to provide relatively high accuracy. For example, the timing circuit 43 can include a crystal oscillator or other type of resonator that provides a highly accurate and stable timing signal.

The first controller 18 also includes two low-pass filters 45. Each filter 45 is communicatively coupled to the microprocessor 40 and the first magnetometer 16. A first of the filters 45 receives information associated with one of the measurement axes of the first magnetometer 16. A second of the filters 45 receives information associated with the other measurement axis of the first magnetometer 16.

The first controller 18 can be programmed to calculate MTF based on inputs from the first magnetometer 16, using techniques commonly known to those skilled in the art of underground drilling.

The first magnetometer 16 and the first controller 18 can be powered by a battery (not shown) or other suitable power source.

The telemetry system 19 transmits information between the first controller 18 and the second controller 23. The telemetry system 19 preferably comprises a first transceiver 50 and an second transceiver 52. The first transceiver 50 can be mounted in the pressure barrel that houses the accelerometers 22, the second magnetometer 20, and the second controller 23. The first transceiver 50 is communicatively coupled to the second controller 23. The second transceiver 52 can be mounted within the cavity 130 of the rotary steerable motor 118, and is communicatively coupled to the first controller 18.

The first and second transceivers 50, 52 preferably communicate via acoustic signals. In particular, the first and second transceivers 50, 52 preferably send and receive acoustic signals to and from each other by way of the drilling mud located in the annulus between the drill string 100 and the side of the borehole. Alternatively, the first and second transceivers 50, 52 may communicate via a radio frequency (RF) link, a wire routed through the wall of the power section of the drill string 100, or other suitable means.

Figure 6:
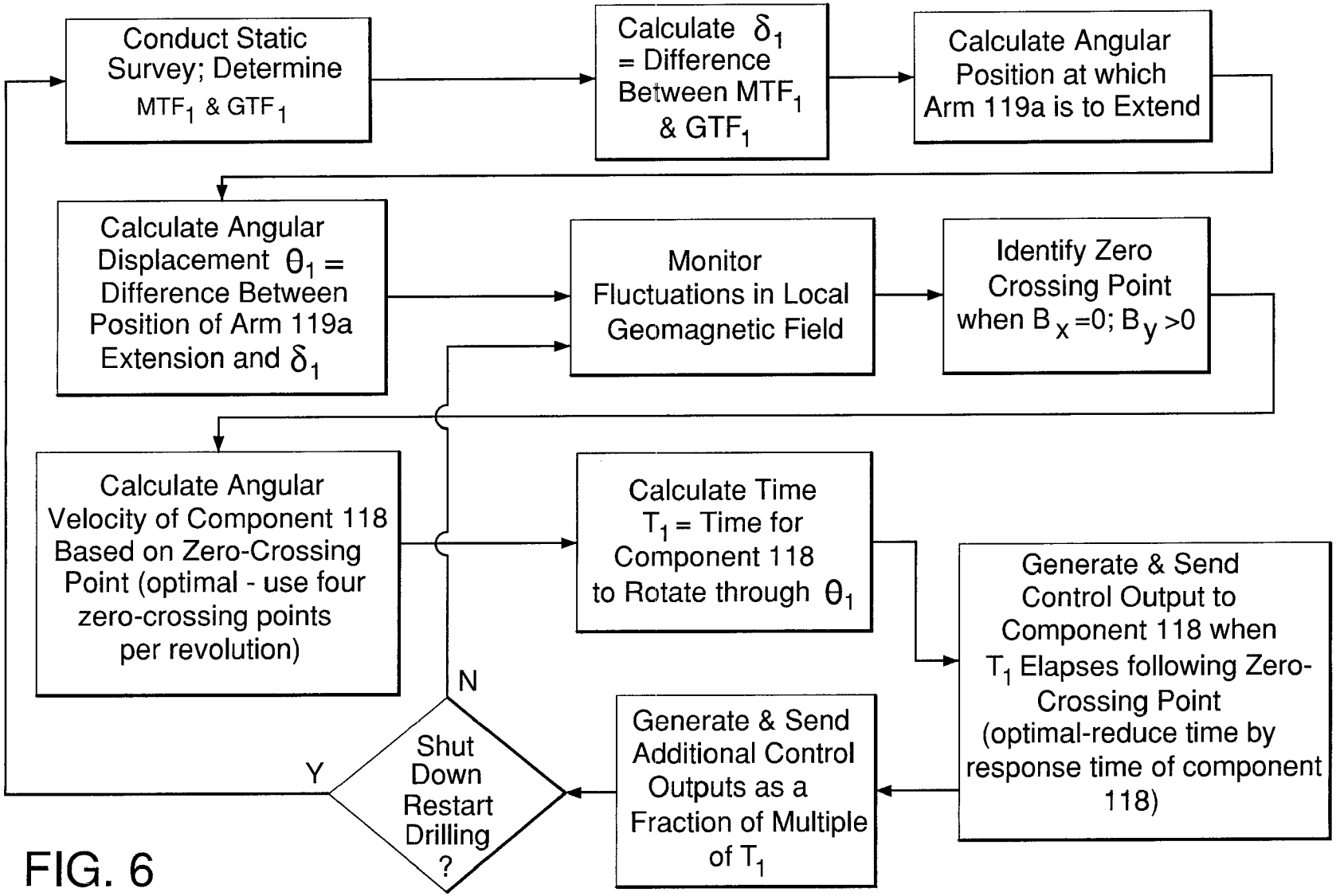
FIG. 6 is a flow diagram of a preferred method that can be performed by the system shown in FIGS. 1-5.

The system 10 can be configured to control the extension and retraction of the arms 119 of the rotary steerable motor 118 based on the angular position of the rotary steerable motor 118, in the manner depicted in FIG. 6.

As shown in FIG. 6, a static survey can be conducted prior to the start of drilling operations. GTF is determined during the static survey, using measurements and calculations provided by the accelerometers 22 and the second controller 23 of the MWD tool 12. GTF readings determined in this manner are hereinafter referred to as "$GTF_1$."

MTF, as measured and calculated using the first magnetometer 16 and the first controller 18, can also be determined during the static survey. MTF readings determined in this manner are hereinafter referred to as "$MTF_1$."

The first controller 18 can be programmed to calculate and store the difference between $GTF_1$ and $MTF_1$ determined during the static survey. This difference, hereinafter referred to as "$\delta_1$," represents a correlation between $GTF_1$ and $MTF_1$. A second value of MTF may be calculated by the second controller 23 based on the outputs of the second magnetometer 20. This value, which may be influenced by the magnetic material around the second magnetometer 20, is referred to hereinafter as "$MTF_2$."

Additional static surveys can be conducted, and the value of $\delta_1$ can be updated when the subsequent drilling operations are interrupted for routine activities such as adding another section of drill pipe 101 to the drill string 100.

During drilling operations, the first controller 18 monitors the angular position of the rotary steerable motor 118, and generates outputs that cause each of the arms 119 to activate when the arm 119 reaches a particular angular position, as follows. The first controller 18 monitors the magnetic field readings generated by the first magnetometer 16. Because the first magnetometer 16 rotates with the rotary steerable motor 118, the magnetic field readings generated by the first magnetometer 16 vary sinusoidally during drilling operations.

Figure 7:
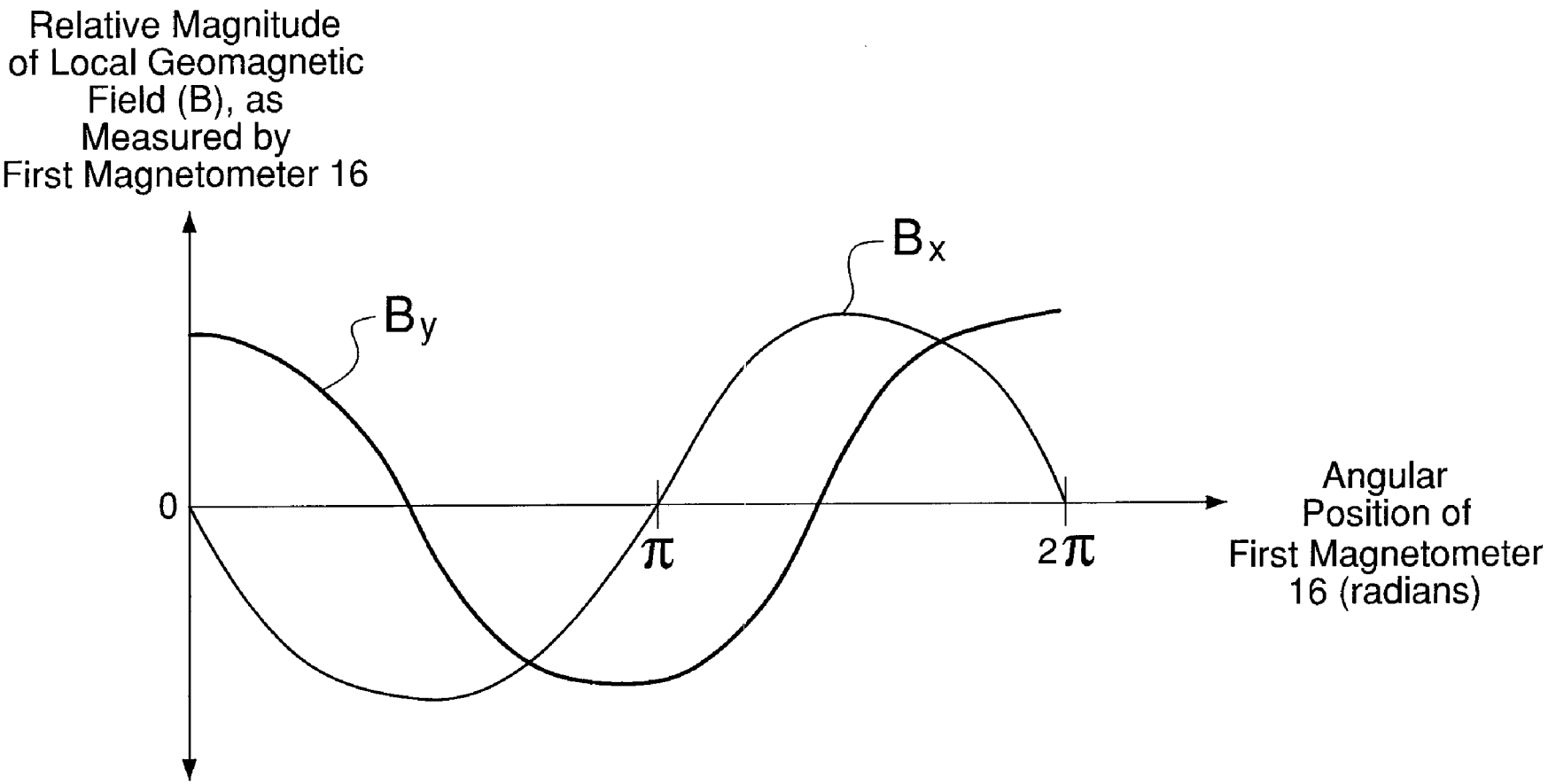
FIG. 7 is a graphical depiction of components of a magnetic field measured by the system shown in FIGS. 1-5, as a function of angular position.

The filters 45 of the first controller 18 filter the direct current (DC) background voltage associated with the outputs of the first magnetometer 16 so that each output, upon reaching the microprocessor 40, is a sinusoidally varying alternating-current (AC) signal 47, as shown in FIG. 7. A second channel of the microprocessor 40 averages the unfiltered signals from the two measurement axes of the first magnetometer 16 during rotation, to calculate the error signals from the magnetic surroundings (which rotate with the first magnetometer 16). These signals are subtracted from the x-axis and y-axis readings during the static surveys so as to substantially eliminate the effect of the error on the value of $MTF_2$.

The signal associated with the y-measurement axis represents the component of the local geomagnetic field in a direction substantially perpendicular to the axis of rotation of the rotary steerable motor 118, and oriented radially outward from the axis of rotation. The component of the local geomagnetic field in this direction is denoted in FIG. 7 by the reference character "$B_y$." The signal associated with the other measurement axis, hereinafter referred to as the "x-measurement axis," represents the component of the local geomagnetic field in direction substantially tangential to the outer circumference of the rotary steerable motor 118. The component of the local geomagnetic field in this direction is denoted in FIG. 7 by the reference character "$B_x$."

As the y and x measurement axes are substantially perpendicular, the signals associated with $B_y$ and $B_x$ are approximately ninety-degrees out of phase, as shown in FIG. 7. Moreover, each signal crosses the horizontal axis twice during each revolution of the rotary steerable motor 118. In other words, the output of the magnetometer 16 has four zero crossing points per revolution.

The first controller 18 is programmed to recognize a particular periodically-varying characteristic in the output of the first magnetometer 16. For example, the first controller 18 can be programmed to recognize the zero crossing point where $MTF_1$ is approximately zero. With the second magnetometer 16 oriented in the above-described manner in relation to the rotary steerable motor 118, $MTF_1$ is approximately zero at the point where $B_x$ is approximately zero and $B_y$ is greater than zero. This zero crossing point is hereafter referred to as "the selected zero crossing point."

The first controller 18 can be programmed to use the selected zero crossing point as a reference against which to determine the specific time at which each of the arms 119 of the rotary steerable motor 118 should be extended. In particular, the first controller 18 can be programmed to calculate the angular velocity of the rotary steerable motor 118. The angular-velocity calculation can be based on the period of rotation of the rotary steerable motor 118, as determined by the time between successive crossings of the selected zero crossing point. The first controller 18 is preferably programmed to calculate the angular velocity using a moving average based on the respective periods of several recent revolutions.

In applications where the angular velocity of the rotary steerable motor 118 can vary significantly, e.g., where substantial stick-slip of the drill bit 104 is expected, the angular velocity calculation can be updated up to four times per revolution. More specifically, the first controller 18 can be programmed to re-average the angular velocity at each zero crossing point of $B_y$ and $B_x$ under such circumstances.

The specific angular position at which the arms 119 are to be extended is based on the desired heading in which the bore 112 is to be drilled. The desired heading is typically expressed in terms of GTF. Information representing the desired heading can be transmitted from the surface to the second controller 23 of the MWD tool 12 by mud pulse telemetry or other suitable means, as discussed above. The information can be relayed from the second controller 23 to the first controller 18 by the telemetry system 19.

As the arms 119 push against the surface of the bore 112 at an angular position approximately opposite the desired heading, the position at which each arm 119 is to be extended is typically offset from the desired heading by approximately 180°. The first controller 18 therefore can be programmed to determine the approximate angular position at which the arms 119 are to be extended by adding or subtracting 180° to the desired heading.

The extension of the arm 119*a* of the rotary steerable motor 118 can be controlled as follows. The first controller 16 can calculate a difference, or offset, between the time at which the first magnetometer 16 indicates the selected zero crossing point, and the time at which the arm 119*a* is to be extended. The offset is calculated based on the angular velocity of the rotary steerable motor 118, the angular position at which the arm 119*a* is to be extended (expressed in terms of GTF), and $\delta_1$. The quantity $\delta_1$ represents a correlation between $GTF_1$ and $MTF_1$, as discussed above. The angular position at which the arm 119*a* is to be extended is expressed in terms of GTF. Thus, adding (or subtracting) the value of $\delta_1$ from the angular position at which the arm 119*a* is to be extended expresses the angular position in terms of $MTF_1$.

The first magnetometer 16 is mounted on the rotary steerable motor 118, proximate the drill bit 104 and other components of the drill string 100 formed from magnetic materials. Hence, the first magnetometer 16 is not located in a "magnetically clean" environment. The proximity of the first magnetometer 16 to magnetic materials can perturb the local geomagnetic field around the first magnetometer 16. $MTF_1$ therefore may not be an accurate indication of the actual MTF of the rotary steerable motor 118.

The first magnetometer 16, however, rotates with the rotary steerable motor 118. Hence, any perturbation of the local geomagnetic field caused by the rotary steerable motor 118 or other components of the drill string 110 is believed to remain substantially constant as the first magnetometer 16 rotates. The correlation between $GTF_1$ and $MTF_1$, reflected in the value of $\delta_1$, therefore remains valid during rotation of the rotary steerable motor 118. Adding or subtracting $\delta_1$ from the desired angular position at which the arm 119*a* is to be extended thus expresses this position in terms of $MTF_1$. The desired angular position at which the arm 119*a* is to be extended, expressed in terms of $MTF_1$, is hereinafter referred to as "$\theta_1$."

The selected zero crossing point occurs when $MTF_1$ is approximately equal to zero, as discussed above. Hence, the angular distance between $\theta_1$ and the position of the rotary steerable motor 118 at the selected zero crossing point is approximately equal to $\theta_1$. The first controller 16 calculates the time required for the rotary steerable motor 118 to rotate through an angular displacement approximately equal to the $\theta_1$, at the angular velocity calculated as the rotary steerable motor 118 passes through the selected zero crossing point. This time interval is hereinafter referred to as "$T_1$."

The first controller 18 sends an electrical signal to the controller 121 of the rotary steerable motor 118 as the time interval $T_1$ elapses following the selected zero crossing point. The controller 121 recognizes the electrical signal as a control input. The controller 121, in response, causes the solenoid associated with the arm 119 to direct pressurized hydraulic fluid to its associated actuator, thereby causing the arm 119*a* to extend. If desired, $T_1$ can be reduced by a predetermined amount to account for any lag in the response of the arm 119*a* to the output signal. The controller 121 can subsequently cause the arm to retract after a predetermined time interval.

The other arms 119 of the rotary steerable motor 118 can be extended based on some multiple or fraction of the time interval $T_1$. The multiple or fraction can be calculated based on the position of the other arms 119 in relation to the arm 119*a*. More particularly, the first controller 18 can be programmed with information representing the angular distance between the arm 119*a* and each of the other arms 119. The first controller 18 can be programmed to calculate the time required for the rotary steerable motor 118 to rotate through an angular displacement corresponding to each of these distances. These time intervals are hereinafter referred to as "$T_2$." The time interval $T_1$ can be increased or reduced by an amount equal to the value for $T_2$ for each arm 119, to determine the point at which that particular arm 119 should be activated. The time interval $T_1$ can be increased or decreased by $T_2$ for a particular arm 119, depending on whether the angular distance between the arm 119 and the angular position at which $MTF_1$ is approximately zero is greater than or less than $\theta_1$.

The above process can be repeated during each revolution of the rotary steerable motor 118, or during predetermined multiples of each revolution.

The first controller 18 thus uses one or more zero crossing points for the local geomagnetic field, as determined by the first magnetometer 16, as a trigger or strobe signal that that initiates the sequence by which the arms 119 are extended. This methodology permits the arms 119 to be extended during drilling operations at a desired angular position referenced to GTF, without a need to calculate GTF (or MTF) while drilling. Rather, the positions of the arms 119 can be monitored on a continuous, real-time basis based on fluctuations in the local geomagnetic field sensed by the first magnetometer 16. The first magnetometer 16 can sense these fluctuations with a relatively high degree of accuracy and reliability. Hence, the system 10 can provide the rotary steerable motor 118 with guidance information that permits the rotary steerable motor 118 to be steered accurately and reliably during drilling operations. Moreover, the system 10 operates autonomously during drilling operations, without a need for inputs from the surface other than information relating to the desired heading.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

For example, alternative embodiments of the system 10 can be configured without the first magnetometer 16 and the first signal processor 18. A zero crossing trigger can be generated during rotation of the rotary steerable motor 118, and can be used to actuate the arms 119 in a manner substantially similar to that described above in relation to the system 10, with the following exceptions.

MTF can be determined during the static survey using the second magnetometer 20 and the second controller 23 in lieu of the first magnetometer 16 and the first controller 18. The difference between MTF and GTF can be calculated and stored in the second controller 23. This difference is hereinafter referred to as "$\delta_2$."

In addition, the difference between the respective angular positions of the second magnetometer 20 and the arm 119*a* can be determined and stored in the second controller 23. The resulting value represents a "scribe line" correction, and is hereinafter referred to as "$\delta_3$."

The second signal processor 23 can be programmed to monitor the fluctuations in the local geomagnetic field measured by the second magnetometer 20 as the MWD tool 12 rotates with the rotary steerable tool 100 during drilling operations, in a manner substantially identical to that described above in relation to the first controller 18.

The second controller 23 can also be programmed to calculate a time interval between a selected zero crossing point, and the point at which the arm 119*a* should be extended to guide the rotary steerable motor 118 in a desired direction. This calculation is based on the desired heading, expressed in terms of GTF, $\delta_2$, $\delta_3$, and the period of rotation of the rotary steerable motor 118.

The desired heading can be increased or decreased by 180° to determine the approximate angular position at which the arm 119*a* needs to extend to push the drill bit 104 in a direction corresponding to the desired heading. The resulting value is increased or decreased by the sum of $\delta_2$ and $\delta_3$, to determine the angular distance between the angular position at which the arm 119*a* needs to be extended, and the selected zero crossing point. This distance is hereinafter referred to as "$\theta_2$."

The second controller 23 can then calculate the time required for the rotary steerable motor 118 to rotate through an angular displacement approximately equal to $\theta_2$. This time is hereinafter referred to as "$T_3$." The second controller 23 generates an output when the time $T_3$ elapses after the arm 119*a* reaches the selected zero crossing point. The output is relayed to the controller 121 of the rotary steerable motor 118 by the telemetry system 19, and causes the arm 119*a* to extend. The remaining arms 119 can be extended when some fraction of multiple of the this time has elapsed, in the manner described above in relation to the first controller 18.

As the second magnetometer 20 is located away from the drill bit 104, it is not subject to interference from the magnetic materials within the drill bit 104. The need to transmit guidance information to the controller 121 on a substantially-continuous basis when using this methodology, however, can potentially place a relatively high load on the telemetry system 19. In some cases, the load may exceed the capacity of a telemetry system suitable for use in the relatively compact down-hole environment.

What is claimed:

1. A method, comprising:

causing a drill string to rotate within an earthen formation;

monitoring the magnetic field of the earthed formation as the drill string rotates;

generating an electrical signal in response to a periodically-varying characteristic of the magnetic field;

sending the electrical signal to a component of the drill string that is responsive to the electrical signal;

determining gravity tool face and magnetic tool face of the component of the drill while the component of the drill string is not rotating;

calculating a difference between the gravity tool face and magnetic tool face determined while the component of the drill string is not rotating;

calculating a first angular position of the component corresponding to a difference between an angular position at which an action of the component of the drill string will be initiated, and the difference between the gravity tool face and magnetic tool face determined while the component of the drill string is not rotating; and timing the generation of the electrical signal based on the difference between the angular position at which a response of the component of the drill string will be initiated, and the difference between the gravity tool face and magnetic tool face determined while the component of the drill string is not rotating.

2. The method of claim 1, further comprising:

calculating an angular velocity of the component of the drill string based on a period of rotation of the component;

calculating a time required for the component of the drill string to rotate from a second angular position at which the periodically-varying characteristic of the magnetic field occurs, to the first angular position based on the angular velocity; and generating the electrical signal based on the time required for the component of the drill string to rotate from the second angular position to the first angular position.

3. The method of claim 2, wherein the magnetic tool face of the component of the drill string is approximately zero when the component of the drill string is in the second position.

4. The method of claim 2, wherein the periodically-varying characteristic of the magnetic field is a measurement of a component of a local geomagnetic field as measured by a magnetometer that rotates with the drill string.

5. The method of claim 4, wherein the periodically-varying characteristic of the magnetic field is a zero value for the component of the local geomagnetic field.

6. The method of claim 2, wherein generating the electrical signal based on the time required for the component of the drill string to rotate from the second angular position to the first angular position comprises generating the electrical signal approximately when the time required for the component of the drill string to rotate from the second angular position to the first angular position elapses after the component of the drill string is in the second angular position.

7. The method of claim 2, wherein generating the electrical signal based on the time required for the component of the drill string to rotate from the second angular position to the first angular position comprises:

calculating a quantity of time equal to a difference between a response time of the component of the drill string to the electrical signal and the time required for the component of the drill string to rotate from the second angular position to the first angular position; and generating the electrical signal approximately when the quantity of time elapses after the component of the drill string is in the second angular position.

8. The method of claim 4, wherein the magnetometer is mounted on the component of the drill string at approximately the same angular position as a portion of the component of the drill string that is responsive to the electrical signal.

9. The method of claim 4, wherein the magnetometer is mounted on the drill string up-hole of the component of the drill string.

10. The method of claim 9, further comprising calculating a difference between an angular position of the magnetometer and an angular position of a portion of the component of the drill string that is responsive to the electrical signal; wherein the first angular position further corresponds to the difference between the angular position at which the action of the component of the drill string will be initiated, and the difference between the angular position of the magnetometer and the angular position of the portion of the component that is responsive to the electrical signal.

11. The method of claim 5, wherein calculating the angular velocity of the component of the drill string based on the period of rotation of the component of the drill string comprises calculating the angular velocity of the component of the drill string based on a periodic occurrence of the zero value for the component of the local geomagnetic field.

12. The method of claim 5, wherein calculating the angular velocity of the component of the drill string based on the period of rotation of the component of the drill string comprises calculating the angular velocity of the component of the drill string based on four periodic occurrences of the zero value for the component of the local geomagnetic field.

13. The method of claim 1, further comprising calculating the angular position at which the action of the component of the drill string will be initiated by calculating a difference between a desired heading along which the drill string is to be steered and 180°.

14. A method, comprising:

drilling a subsurface bore using a rotating drill string;

calculating a time required for a rotating component of the drill string to rotate through an angular displacement approximately equal to an angular distance between a first angular position of the rotating component, and a second angular position of the rotating component at which a predetermined action of the rotating component will be initiated;

determining when the rotating component reaches the first angular position by measuring a quantity that varies with the angular position of the rotating component; and monitoring the time that elapses after the rotating component reaches the first angular position until at least the time that it reaches approximately the second angular position.

15. The method of claim 14, wherein the quantity that varies with the rotation of the rotating component varies periodically with the rotation of the drill string.

16. The method of claim 14, wherein the quantity that varies with the rotation of the rotating component is a component of a magnetic field measured by a magnetometer that rotates with the rotating component.

17. The method of claim 14, further comprising sending a control input to the rotating component to cause the predetermined response of the rotating component to take place when the rotating component is located approximately at the second position.

18. The method of claim 17, further comprising sending the control input to the rotating component approximately when the time required for the rotating component to translate through the angular distance elapses after the rotating component reaches the first angular position.

19. The method of claim 17, further comprising:

calculating a time interval equal to a difference between the time required for the rotating component to translate through the angular distance and a response time of the rotating component to the control input; and sending the control input to the rotating component approximately when the time interval elapses after the rotating component reaches the first angular position.

20. The method of claim 16, wherein the component of the magnetic field measured by the magnetometer is approximately zero when the rotating component is in the first position.

21. The method of claim 17, wherein sending a control input to the rotating component to cause the predetermined response of the rotating component to take place when the rotating component is located approximately at the second position comprises sending the control input electrical to cause an arm of the rotating component to extend and push against the earth formation thereby steering the drill string.

22. The method of claim 21, wherein the rotating component is a rotary steerable motor.

23. The method of claim 16, wherein the magnetometer is mounted on the rotating component at approximately the same angular position as a portion of the rotating component that is responsive to the control input.

24. The method of claim 16, wherein the magnetometer is mounted on the drill string up hole of the rotating component.

25. A method, comprising:

drilling a subsurface bore using a rotating drill string;

calculating a time required for a rotating component of the drill string to rotate through an angular displacement approximately equal to an angular distance between a first angular position of the rotating component, and a second angular position of the rotating component at which a predetermined action of the rotating component will be initiated;

determining when the rotating component reaches the first angular position by measuring a quantity that varies with the angular position of the rotating component, wherein the quantity that varies with the rotation of the rotating component varies periodically with the rotation of the drill string;

monitoring the time that elapses after the rotating component reaches the first angular position until at least the time that it reaches approximately the second angular position;

determining gravity tool face and magnetic tool face of the component while the rotating component is not rotating;

calculating a difference between the gravity tool face and magnetic tool face determined while the rotating component is not rotating; and determining the second angular position by calculating a difference between an angular position at which a response of the rotating component is to be initiated, and the difference between the gravity tool face and magnetic tool face determined while the rotating component is not rotating.

26. The method of claim 25, further comprising:

calculating an angular velocity of the rotating component based on a period of rotation of the rotating component; and calculating the time required for a rotating component of the drill string to rotate through the angular displacement based on the angular velocity of the rotating component.

27. The method of claim 25, wherein the magnetic tool face of the component is approximately zero when the component is in the first position.

28. The method of claim 26, wherein calculating an angular velocity of the rotating component based on a period of rotation of the rotating component comprises calculating the angular velocity of the rotating component based on a periodic occurrence of a zero value for a value of a magnetic field measured by a magnetometer that rotates with the rotating component.

29. The method of claim 26, wherein calculating an angular velocity of the rotating component based on a period of rotation of the rotating component comprises calculating the angular velocity of the rotating component based on four periodic occurrences of a zero value for a value of a magnetic field measured by a magnetometer that rotates with the rotating component.

30. The method of claim 25, further comprising calculating the angular position at which the action of the component is to be initiated by calculating a difference between a desired heading along which the drill string is to be steered and 180°.

31. A method, comprising:

determining gravity tool face and apparent magnetic tool face of a rotatable component while the rotatable component is not rotating;

determining an offset between the gravity tool face and the apparent magnetic tool face;

determining a first angular position by calculating a difference between the offset and an angular position at which a desired action of the rotatable component is to be initiated;

measuring a component of a geomagnetic field around the rotatable component while the rotatable component is rotating;

calculating an angular distance between the first angular position and a second angular position at which a measured value of the geomagnetic field is approximately zero; and calculating a time required for the rotatable component to rotate from the second angular position to the first angular position.

32. The method of claim 31, further comprising sending an electrical signal to the rotatable component to cause a response to be initiated approximately when the time required for the rotatable component to rotate from the first angular position to the second angular position elapses after the rotatable component is in the first angular position.

33. The method of claim 31, wherein magnetic tool face is approximately zero when the rotatable component is in the second angular position.

34. A system, comprising:

at least two accelerometers that measure components of a gravitational field around a rotatable component of a drill string;

a two or three-axis magnetometer that measures components of a magnetic field around the rotatable component;

a first controller communicatively coupled to the accelerometers and the magnetometer, wherein the controller generates an electrical signal in response to a periodically-varying characteristic of the magnetic field, and sends the electrical signal to a component of the drill string that is responsive to the electrical signal; and a second controller communicatively coupled to the accelerometers, and a telemetry system that communicatively couples the first and second controllers, the second controller mounted up hole of the telemetry system, wherein the first controller determines gravity tool face and magnetic tool face of the component while the component is not rotating; calculates a difference between the gravity tool face and magnetic tool face determined while the component is not rotating; and calculates a first angular position corresponding to a difference between an angular position at which an action of the component will be initiated, and the difference between the gravity tool face and magnetic tool face determined while the component is not rotating.

35. The system of claim 34, wherein the first controller calculates an angular velocity of the component based on a period of rotation of the component; calculates a time required for the component to rotate from a second angular position at which the periodically-varying characteristic of the magnetic field measurement occurs, to the first angular position based on the angular velocity; and generates the electrical signal based on the time required for the component to rotate from the second angular position to the first angular position.

36. The method of claim 35, wherein the magnetic tool face of the component is approximately zero when the component is in the second position.

* * * * *